United States Patent [19]

Richmond

[11] 4,166,204

[45] Aug. 28, 1979

[54] SWITCH FOR TIMER

[75] Inventor: James W. Richmond, Charlotte, N.C.

[73] Assignee: General Time Corporation, Thomaston, Conn.

[21] Appl. No.: 867,038

[22] Filed: Jan. 5, 1978

[51] Int. Cl.[2] ..... H01H 21/04

[52] U.S. Cl. ..... 200/67 D

[58] Field of Search ..... 200/67 D, 67 G, 68, 200/77, 153 L, 154, 282

[56] References Cited

U.S. PATENT DOCUMENTS

| | | | |
|---|---|---|---|
| 2,734,959 | 2/1956 | Immel | 200/67 D |
| 2,788,409 | 4/1957 | Grover | 200/67 D |
| 2,839,624 | 6/1958 | Stolle | 200/67 D |
| 3,548,131 | 12/1970 | Piber | 200/67 D |

*Primary Examiner*—Herbert F. Ross

*Attorney, Agent, or Firm*—Pennie & Edmonds

[57] ABSTRACT

The switch for timer is comprised of a single pole, double throw switch. The switch includes a plurality of contact arms, the two outer arms being substantially fixed in disposition while a center arm is capable of movement therebetween to positions of contact. A slot extends in substantially a longitudinal direction from one end of the center arm. The slot provides a demarcation between the contact carrying portion of the center arm and a portion adapted to be connected with an actuator through a spring. Movement of the actuator imparts movement to the center arm by snap action from one stable position of contact to another. However, up to the instant of a break as the actuator passes through an over center position the slot permits the contact carrying portion to maintain good contact pressure against the contact at one of the positions.

5 Claims, 11 Drawing Figures

SWITCH FOR TIMER

BACKGROUND OF THE INVENTION

The switch of the present invention is of the family of switches having application in timing apparatus, as for example, apparatus adapted for use in the control of a conditioning system. The conditioning system may have a 12-hour but preferably a 24-hour timed cycle within which two or more members will each complete one excursion to actuate a switch at times which are preset. Each member is comprised of a pin which rotates about an axis and into contact with an inclined surface formed on an element carried by a switch actuator. The switch is a single pole, double throw switch having a center arm which undergoes snap action from one to another stable position of contact with an outer arm. The switch actuator is pivotally mounted and operatively connected to the center arm by a loading means. When the switch actuator following movement of a pin along the inclined surface of the element moves through an over center position the center arm will undergo the aforementioned snap action.

As should be appreciated, these devices wherein a member, such as the aforementioned pin completes an excursion throughout a 12 or 24-hour cycle are extremely slow in action. This slowness of action has been found to introduce a noticeable disadvantage in the operation of switches of this type. Thus, the center arm and contact slowly withdraws from its contact with an outer arm as the pin follows the inclined surface with the result that only extremely light contact pressure which reduces to zero substantially prior to actuation from one stable position to the other is maintained. This condition has been found exceptionally undesirable in applications of the prior art switches in the timing of an operation in an environmental control system for the purpose of providing a variety of operating conditions such as temperature during certain periods of time. To this end, in some situations it has been found that there may be an interruption in contact for as long as several minutes time. A further disadvantage of a slow withdrawal of one contact from another contact, depending upon the voltage characteristics of the system results from arcing and the deterioration of the contacts.

BRIEF DESCRIPTION OF THE INVENTION

The present invention is in a switch of the above described type yet having capability of switch contact transfer within a period of only a few milliseconds. The switch contact transfer is accomplished even in the adaptation of the switch with devices having an extremely slow speed of operation. And, the switch of the present invention is capable of maintaining good contact pressure up to the instant of break of the contact of the center arm in excursion from one stable position of contact to another.

The switch of the present invention includes a plurality of stacked contact arms, a center arm being controlled in operation for movement between stable positions of contact with an outer arm by an actuator which is moved through an over center position. The actuator is mounted at one end for pivotal movement and carries an element having a pair of inclined surfaces at the other end. As indicated, two or more members each supporting a pin and driven by a timing mechanism interact with respective inclined surfaces to impart movement to the actuator. A loading means connects the actuator to the center arm. As an important aspect of the invention, the center arm has a slot extending substantially longitudinally from one end. The slot extends along a length of the center arm and separates the portion upon which the contact is located from the portion to which the loading means is connected. The slot permits, as the actuator moves toward the over center position, the contact of the center arm to remain under condition of good contact pressure in contact with the contact of an outer arm. Then, as the actuator moves through an over center position the center arm contact rapidly separates and transfers to a position of contact with the other outer arm. The switch transfer time is within a few milliseconds.

There has thus been outlined rather broadly the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may be readily utilized as a basis for the designing of other structures for carrying out the several purposes of the invention. It is important, therefore, that the claims be regarded as including such equivalent construction as do not depart from the spirit and scope of the invention.

DETAILED DESCRIPTION OF THE PREFERRED EMBODIMENT

Figure 1:
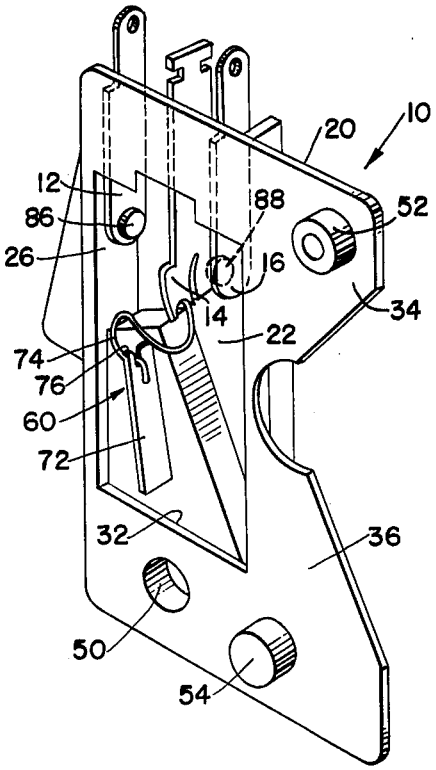
FIG. 1 is a perspective view of the switch for timer made in accordance with the principles of the present invention.

The switch of the present invention is adapted for use in many combinations, although it is particularly adapted for use in an environmental control system having capability, among others, of the control or regulation of a condition such as temperature within an enclosed space. Typically the switch in systems of this type is actuated by a timing device having a very slow operating cycle, i.e., one of 12 or 24-hour cycle variety. However, since the environmental control system forms no direct part of the present invention other than that it is an adaptation for the switch to be described it may be considered as being conventional. The timing device may be considered conventional, also, and is illustrated in the drawing and described below to the extent necessary to understand the operation of the switch.

Figure 2:
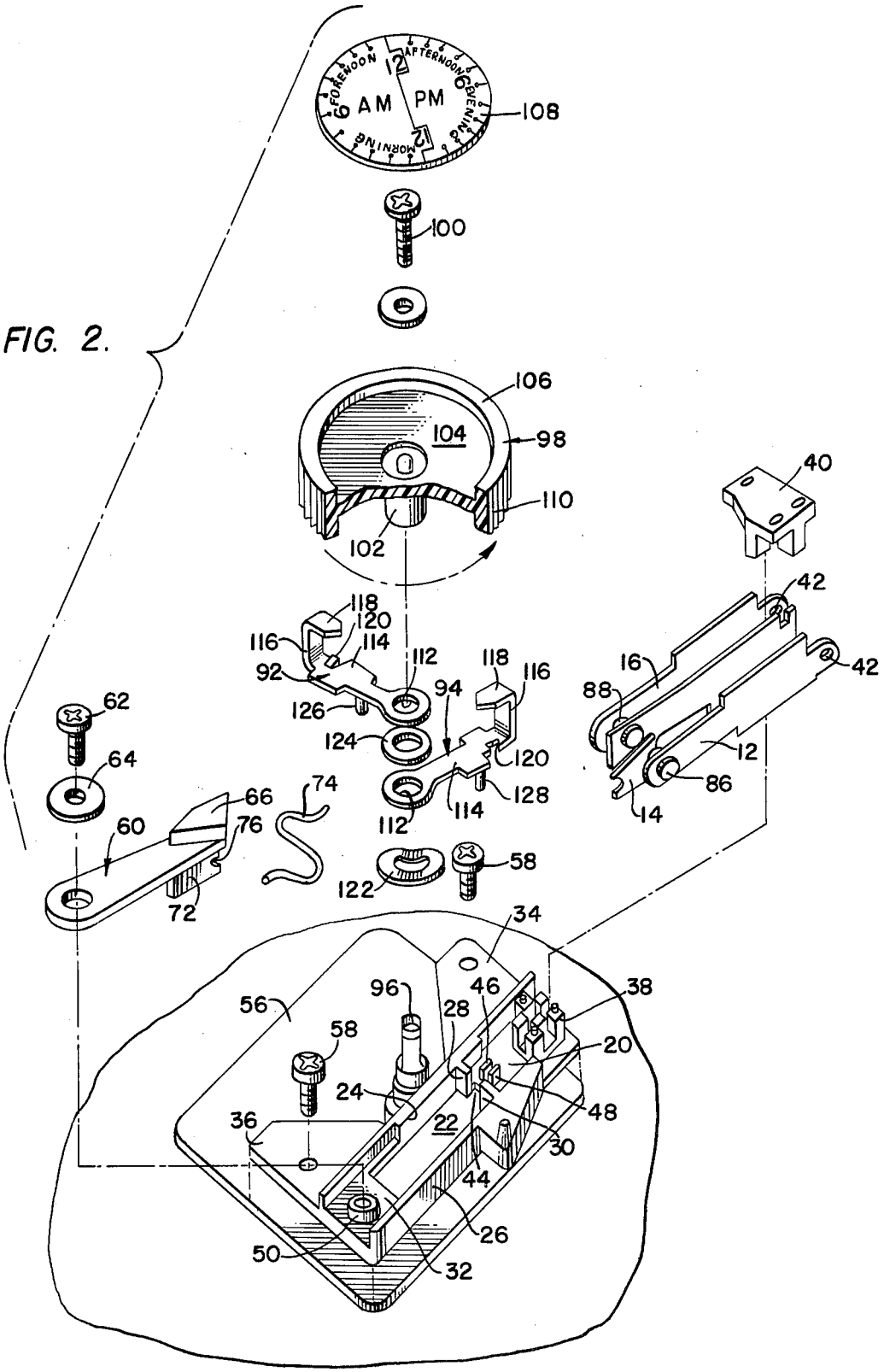
FIG. 2 is an exploded perspective view of the operative components of the switch for timer of FIG. 1, the components for actuating the switch and mounting plate.

The switch of the present invention, illustrated generally by the numeral 10, may be seen to best advantage in FIGS. 1 and 2 of the drawing. The switch includes a plurality of three arms 12, 14 and 16 carrying contacts and arranged in a stacked fashion to define a pair of outer arms and a center arm. A housing 18 supports the arms in cantilever fashion to extend from one end over a surface 20 and into an open area 22. The open area is bounded by a pair of side rails 24 and 26, a pair of partitions 28 and 30 which extend from the rails in confronting arrangement and a surface 32 at the other end of the housing. The housing is completed by a pair of ears 34 and 36 extending in a direction transverse to the rail 24. The area of merger with the rail is provided with a rounded cut out. This and the aforedescribed features of the housing (best seen in FIG. 2) will be further discussed below.

The arms 12, 14 and 16 formed as an elongated blade may be supported in any convenient fashion. In the present embodiment, a base in the form of a plurality of upstanding fingers 38 comprising an integral portion of surface 20 and a cover 40 formed complementary to the base provide such support. To this end, the several arms are disposed so that their respective blade surfaces are supported between the upstanding and depending fingers when the cover is received on the base. Thus, the arms are immobilized against lateral movement and against longitudinal movement either by the frictional engagement or by means of a potting compound (not shown). The ends of arms 12 and 16 are reduced in width and are formed with an aperture 42 for facilitating connection of an electrical lead (not shown).

This support will provide that the arms 12, 14 and 16 extend through an opening 44 between the partitions 28 and 30 into the open area 22. A pair of upstanding supports 46 and 48 are disposed within the region of the partitions and together with a respective confronting end of a partition function to immobilize substantially the cantilevered ends of arms 12 and 16. The center arm 14 extends between the supports 46 and 48 and is actuated in a manner to be discussed from a position of contact from one to the other of arms 12 and 16.

The housing 18 preferably is formed of one of the plastic materials conventionally used in adaptations of this type. The cover 40 may be similarly formed thereby to provide a nonconductive mounting for the arms 12, 14 and 16. Other insulative material (not shown) may be employed, as desired.

A hub 50 having a center opening extends upwardly of the surface 32. And, a pair of hubs 52 and 54 extend downwardly from the undersurface of ears 34 and 36. The latter hubs with a similar opening space the housing 18 from a plate 56 which may support a motor (not shown). The housing may be mounted on the plate by screws 58 received through the respective openings in each hub 52 and 54 and threaded into a tapped bore (not shown) in plate 56.

An actuator 60 is received on hub 50. The actuator is in the form of an elongated arm with an opening providing a pivotal mount on the hub. Securement may be by means of a screw 62 received through an opening in one end of the actuator and threaded into the hub 50. A washer 64 disposed between the screw and actuator serves to provide freedom in movement of the actuator.

As may be seen in FIG. 2, the actuator supports an element 66 having a pair of cam surfaces 68 and 70, both inclined outwardly from the apex directed substantially toward the pivotal axis of the actuator. While the actuator is disposed substantially within the open area 22 bounded by the rails 24 and 26 the element 66 is disposed above the plane of the upper surfaces of the rails.

A member 72 is supported on the other surface of the actuator and within the open area 22. The member serves as a retainer for one end of the loading means in the form of an "S" spring 74. The member 72 is defined by an elongated plate having an opening 76 into which an end of the "S" spring may be received. The other end of the "S" spring is received by the center arm 14.

Figure 3:
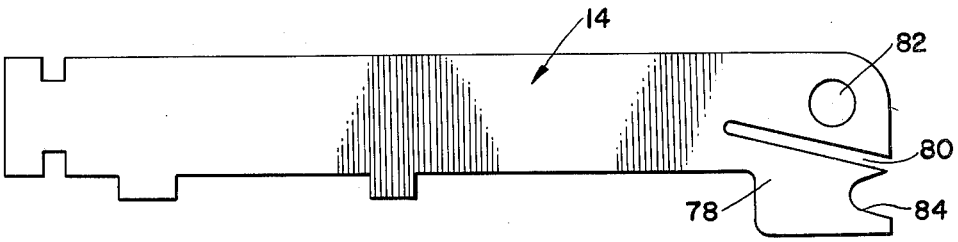
FIG. 3 is a partial plan view of the center arm of the switch illustrating the arrangement of the slot at one end.

The center arm 14 may be seen to good advantage in FIG. 3. The center arm is of a form like that of the arms 12 and 16 although including an enlarged contact carrying end at 78. As an important aspect of the present invention, a slot 80 extends throughout the enlarged end and generally longitudinally of the center arm to separate the portion which carries a contact 82 from the portion having a groove 84 into which the other end of the "S" spring 74 is received. The manner of support of the "S" spring best seen in FIG. 1 is such that it is compressed in installation between the portion of the center arm 14 and the member 72 of actuator 60. The preload introduced by the "S" spring assures that there is an acceptable level of contact force exerted between the contact 82 of the center arm and the contacts 86 and 88 on arms 12 and 16, respectively. The force exerted on the center arm by the "S" spring causes the portion of the center arm to which it is secured to yield such that the component side force on this portion of the center arm is equal to the component side force on the contact 82 disposed toward the contact 88 on arm 16.

Figure 4A:
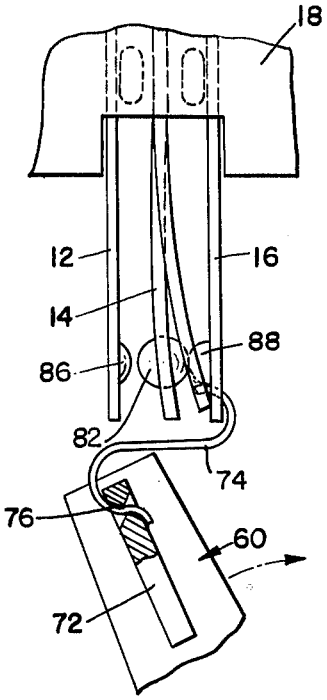
FIGS. 4A, 5A and 6A are schematic presentations of the switch illustrating movement of the center arm from one stable contact position at one outer arm, to a second stable contact position at the other outer arm and at a position of the center arm immediately prior to snap action to the latter.
Figure 5A:
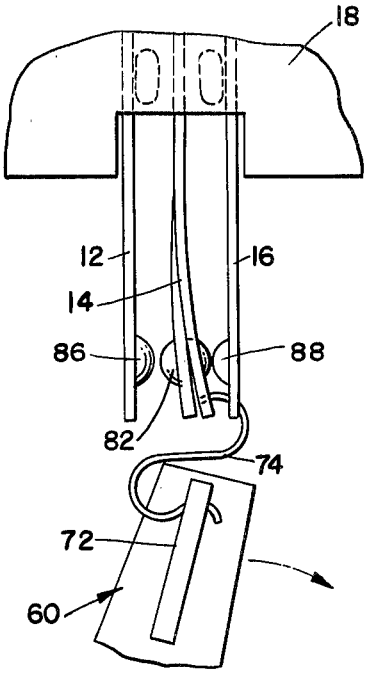
Figure 6A:
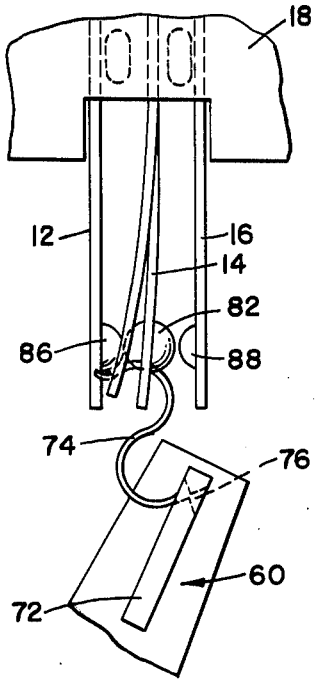

In operation, the center arm 14, under the control of actuator 60, will transfer between the contact position of FIG. 4A to the contact position of FIG. 6A within a time interval of only a few milliseconds. It has been found that transfer may be accomplished within a time interval of from about 8 to about 16 milliseconds and up to the instant of break (see FIG. 5A) an adequate level of contact pressure is maintained between the contact 82 of the center arm 14 and one of the contacts 86 or 88. The illustration of FIG. 4A illustrates a stable contact closed condition. The "S" spring 74 which in assembly is preloaded maintains an acceptable amount of contact force thereby to assure good contact pressure between the closed contacts of the cantilevered center arm 14 and one of the arms 12 and 16. As indicated, the latter arms are immobilized by the surfaces of partitions 28 and 30 and supports 46 and 48. As also indicated, the center arm is not subject to restraint of this type and, accordingly, it is free to bend at its support so that it is capable of movement between the stable positions of FIG. 4A and FIG. 6A. In the stable positions the split between the portions in the enlarged end is a maximum.

FIG. 5A illustrates the actuator 60 undergoing slowly pivotal movement in the clockwise direction. As the actuator moves toward a center position, the "S" spring resultant force will increase slightly while the side component force, as exerted by the "S" spring on the upper portion of the contact blade, decreases. As the actuator moves over center, the component side force on the upper center arm and the lower center arm not only are very small but equal and opposite. This condition also is true at break which occurs at about the same time. Since two small but finite equal and opposite side forces act on the center arm at break, only a slight split (minimum split in FIG. 5A) in the portions of the arms at break will exist. It is this feature that allows the switch to provide at least a small contact pressure right up to the break point and then permit a break with little or no chatter.

Figure 4B:
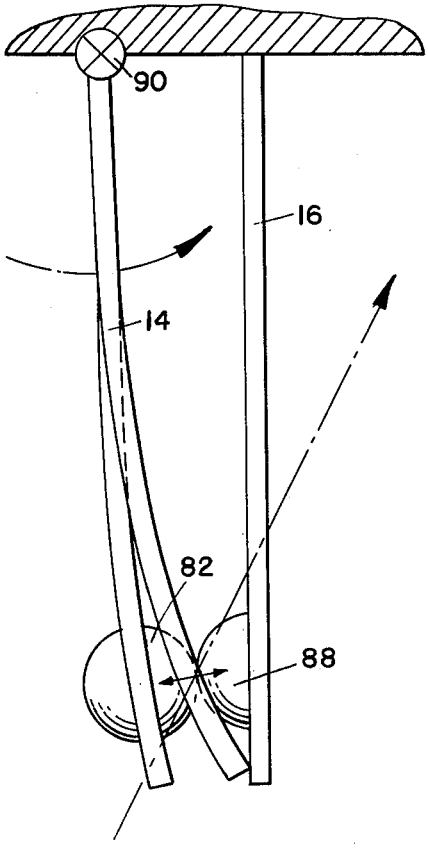
FIGS. 4B, 5B and 6B are diagrammatic illustrations of an outer arm and the center arm illustrating the movement of the main force vector as the center arm moves from a stable position, at the disposition at the break point, and at the disposition an instant past the break point.
Figure 5B:
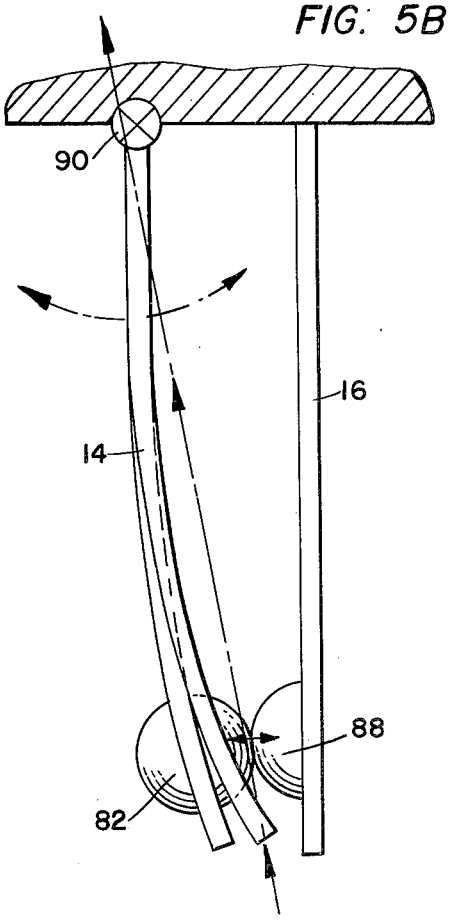
Figure 6B:
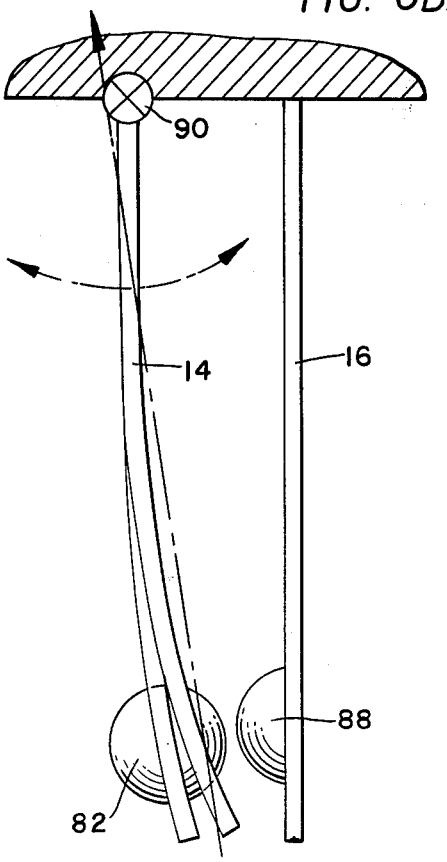
Figure 8:
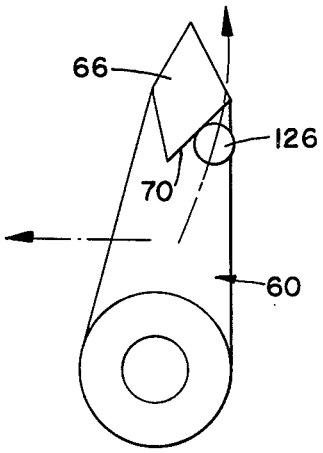

To illustrate, further, the manner of operation attention may be directed to FIGS. 4B, 5B and 6B. These figures illustrate both the main force vector and that of the side forces which are significant in the operation of the switch. As may be seen in FIg. 4B, the main force vector is located substantially to the right of the pivot point 90 of center arm 14. As the actuator 60 is caused to pivot in a clockwise direction the main force vector rotates in a counterclockwise direction through the position of FIG. 5B to the position of FIG. 6B whereat the main force vector assumes a position to the left of pivot point 90. When the line of action of the main force vector shall have passed through the pivot point 90, the center arm 14 will very rapidly transfer by snap action thereby to move to the stable position illustrated in FIG. 6A whereat the contact 82 of center arm 14 provides circuit continuity with contact 86 of arm 12. The illustration of FIG. 5A is representative of the position of the center arm in FIG. 5B just prior to transfer.

The center arm 14 will transfer through similar action in the reverse direction.

Turning again to FIG. 2, it will be seen that the means to impart movement to actuator 60 includes a pair of trip elements 92 and 94 which may be adjusted angularly. A shaft 96 driven by the motor supports the trip elements and a drum 98, the latter of which is fixed for rotation with the shaft. The shaft extends through plate 56 and is accommodated by the rounded cutouts formed in the ears 34 and 36.

The drum is fixed to the shaft by means of a screw 100 received through an opening in a neck portion 102 and threadedly received in a tapped bore within the shaft end. The drum includes a plate portion 104 which supports both the neck portion 102 and a cylindrical wall 106. A disc 108 may be frictionally received within the area of the cylindrical wall above the plate portion 104. The disc suitably carries an indicia presentation of time, either of a 12-hour or 24-hour cycle. The lower cylindrical wall is serrated therearound at 110.

The trip elements 92 and 94 are substantially identically formed thereby to provide an opening 112 at one end, an arm portion 114 extending therefrom having an upturned flange portion 116 and an indicating tab 118 including a pointer. A pawl 120 is formed or otherwise carried by each arm, the pawl and the serrations 110 permitting an interaction whereby the trip elements will be driven by the drum 98 as the drum is driven by the motor. However, the trip elements may be adjusted relative to the drum and particularly the indicia presentation on disc 108. To this end, the trip elements are received on the shaft 96 and supported by a pair of spring washers 122 and 124. Thus, each trip element may be urged downwardly against its spring washer, i.e., the trip elements 92 and 94 operating against spring washers 122 and 124, respectively, to disengage the pawl from the serrations for adjustment. The adjustment will determine the time of operation of the switch in its transfer from a switch contact position, for example, of FIG. 4A to the position of FIG. 6A and on return.

Figure 7:
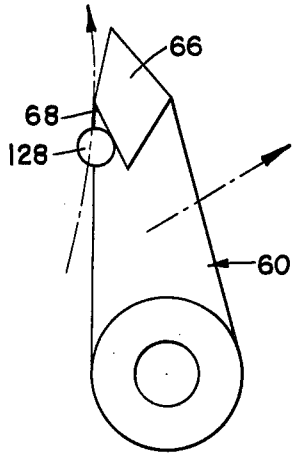
FIGS. 7 and 8 are diagrammatic views of the actuator and a trip pin carried by the timer mechanism for imparting movement to the actuator and consequently the center arm.

The trip elements 92 and 94 carry a trip 126 and 128, respectively. The two trips are located at dissimilar radial distances from the axis of shaft 96 thereby to act on one or the other of the cam surfaces 68 and 70. Thus, upon rotation of the shaft 96 the trip elements 92 and 94 which shall have been adjusted are driven by drum 98 thereby ultimately to present a trip to a respective cam surface. In FIG. 7 the actuator 60 is in the position whereby cam surface 68 is engaged by trip 128 to cause actuator 60 to pivot in the clockwise direction (FIG. 2). As set out above, the center arm 14 will transfer rapidly by a snap action imparted by the "S" spring 74 when the trip has traversed some distance along cam surface 68 whereby electrical contact is made through contacts 82 and 88. Subsequently the trip 126, rotated to a position of engagement with cam surface 70, will cause the actuator 60 to undergo movement in the counterclockwise direction thereby to cause the center arm 14 to snap in the other direction whereby electrical contact is made through contacts 82 and 86.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

What is claimed is:

1. A switch including a plurality of contact arms and housing means for mounting said arms in juxtaposed stacked relation, said contact arms comprising a pair of outer arms and a center arm, an actuator mounted by said housing means and adapted for pivotal movement, loading means operatively connecting said actuator and center arm so that upon movement of said actuator in one direction or the other through an over center position said loading means will cause said center arm to break contact with one outer arm and transfer with snap action to the other outer arm, and said center arm having a slot extending from the contact end defining a center arm portion which connects the loading means to the center arm and a contact portion, said center arm portion being pivotally moved in the same direction as said contact portion yet through a greater distance than the contact portion whereby said contact at least by small contact pressure will be maintained up to said break and transfer.

2. The switch of claim 1 in which said contact positions of said center arm are stable positions.

3. The switch of claim 2 wherein said loading means includes an "S" spring, each said center arm and actuator including support means and said "S" spring received by said support means thereby to be in a state of compression in each said stable position.

4. The switch of claim 3 in which said slot extends substantially longitudinally of said center arm, the portion on one side of said slot defining a contact portion and said support means disposed on the portion on the other side of said slot.

5. The switch of claim 4 wherein said "S" spring resultant force increases while the side component force on said contact position decreases as said actuator moves toward said over center position.

* * * * *